US005251703A

United States Patent [19]

Skinner

[11] Patent Number: 5,251,703

[45] Date of Patent: Oct. 12, 1993

[54] HYDRAULIC SYSTEM FOR ELECTRONICALLY CONTROLLED DOWNHOLE TESTING TOOL

[75] Inventor: Neal G. Skinner, Lewisville, Tex.

[73] Assignee: Halliburton Company, Duncan, Okla.

[21] Appl. No.: 909,056

[22] Filed: Jul. 2, 1992

Related U.S. Application Data

[63] Continuation of Ser. No. 658,485, Feb. 20, 1991, abandoned.

[51] Int. Cl.[5] ..... E21B 34/10

[52] U.S. Cl. ..... 166/374; 166/65.1; 166/66.4; 166/319

[58] Field of Search ..... 166/319, 316, 336, 65.1, 166/373, 374, 250, 264, 386, 66.4

[56] References Cited

U.S. PATENT DOCUMENTS

| | | | |
|---|---|---|---|
| 3,856,085 | 12/1974 | Holden et al. | 166/264 |
| 4,113,012 | 9/1978 | Evans et al. | 166/264 |
| 4,266,606 | 5/1981 | Stone | 116/113 |
| 4,347,900 | 9/1982 | Barrington | 166/380 |
| 4,375,239 | 3/1983 | Barrington et al. | 166/336 |
| 4,378,850 | 4/1983 | Barrington | 166/373 |
| 4,422,506 | 12/1983 | Beck | 166/324 |
| 4,711,305 | 12/1987 | Ringgenberg | 166/336 |
| 4,796,699 | 1/1989 | Upchurch | 166/250 |
| 4,856,595 | 8/1989 | Upchurch | 166/374 |
| 4,866,607 | 9/1989 | Anderson et al. | 364/422 |
| 4,880,060 | 11/1989 | Schwendemann et al. | 166/319 X |
| 4,896,722 | 1/1990 | Upchurch | 166/250 |
| 4,915,168 | 4/1990 | Upchurch | 166/250 |
| 5,050,681 | 9/1991 | Skinner | 166/374 |

*Primary Examiner*—Hoang C. Dang
*Attorney, Agent, or Firm*—Jennifer R. Daunis; Lucian Wayne Beavers

[57] ABSTRACT

A hydraulic system is provided for an electronically controlled downhole testing tool. The tool operates on a pressure differential between the well annulus and a substantially atmospheric pressure dump chamber defined in the tool. Power passages communicate a power piston with the well annulus and the dump chamber. Normally closed electric solenoid control valves are disposed directly in the power passages to control fluid flow therethrough. A pressure regulator regulates the pressure differential across the electric solenoid control valves.

27 Claims, 2 Drawing Sheets

HYDRAULIC SYSTEM FOR ELECTRONICALLY CONTROLLED DOWNHOLE TESTING TOOL

This is a continuation of copending application Ser. No. 07/658,485, filed on Feb. 20, 1991, now abandoned.

BACKGROUND OF THE INVENTION

1. Field Of The Invention

The present invention relates generally to a system for actuating downhole tools in response to a pressure differential.

2. Description Of The Prior Art

The basic function of most downhole tools involves surface manipulation of a downhole operation system to accomplish a task such as opening a valve, for example the opening and closing of a tester valve or a circulation valve.

This process usually involves a linear actuator, i.e., a power piston, which works off a pressure differential acting across a hydraulic area.

There are several ways in which this pressure differential can be achieved to operate such a linear actuator.

One technique is the use of a nitrogen charged system in which the nitrogen acts as a spring which supports hydrostatic well annulus pressure, but which can be further compressed with applied pressure at the surface allowing linear actuation across a hydraulic area downhole. An example of such a tool is seen in U.S. Pat. No. 4,711,305 to Ringgenberg.

Yet another system provides first and second pressure conducting passages from either side of the power piston to the well annulus. A metering orifice type of retarding means is disposed in the second pressure conducting passage for providing a time delay in communication of changes in well annulus pressure to the second side of the power piston. Accordingly, a rapid increase or rapid decrease in well annulus pressure causes a temporary pressure differential across the piston which moves the piston. An example of such a system is seen in U.S. Pat. No. 4,422,506 to Beck.

Still another approach is to provide both high and low pressure sources within the tool itself by providing a pressurized hydraulic fluid supply and an essentially atmospheric pressure dump chamber. Such an approach is seen in U.S. Pat. No. 4,375,239 to Barrington et al.

Another approach is to utilize the well annulus pressure as a high pressure source, and to provide an essentially atmospheric pressure dump chamber as the low pressure zone within the tool itself. Such an approach is seen in U.S. Pat. Nos. 4,796,699; 4,856,595; 4,915,168; and 4,896,722, all to Upchurch.

The present invention provides a downhole tool operating system of the type generally like that disclosed in the Upchurch patents identified above, in that it utilizes a pressure differential between the well annulus and an essentially atmospheric pressure dump chamber defined within the tool. The present tool is greatly simplified, however, as compared to the Upchurch arrangement.

SUMMARY OF THE INVENTION

A downhole apparatus includes a housing having a power chamber, a high pressure source chamber and a low pressure dump chamber defined therein. The housing has a power port defined therein communicating the high pressure source chamber with a well annulus surrounding the housing.

A power piston is slidably disposed in the power chamber and divides the power chamber into first and second power chamber portions.

A pressure transfer piston is slidably disposed in the high pressure source chamber and divides the high pressure source chamber into a well side chamber portion and a tool side chamber portion. The well side chamber portion is in fluid flow communication with the power port.

The housing further includes a power passage means defined therein for providing fluid pressure communication between the power chamber and each of the well side chamber portion and the low pressure dump chamber. The power passage means includes four flow paths defined therein. A first flow path communicates the first power chamber portion with the tool side chamber portion of the high pressure source chamber. A second flow path communicates the second power chamber portion with the low pressure dump chamber. A third flow path communicates the second power chamber portion with the tool side chamber portion of the high pressure source chamber. The fourth flow path communicates the first power chamber portion with the low pressure dump chamber.

Additionally the tool includes an electric solenoid control valve means disposed directly in the power passage means for selectively controlling fluid pressure communication between the power chamber and each of the tool side chamber portion and the low pressure dump chamber. The electric solenoid control valve means has a first position wherein the first power chamber portion is communicated with a too side chamber portion and the second power chamber portion is communicated with the low pressure dump chamber so that a pressure differential between the well annulus and the low pressure dump chamber acts in a first direction across the power piston. The control means has a second position wherein the first power chamber portion is communicated with the low pressure dump chamber and the second power chamber portion is communicated with the tool side chamber portion so that the pressure differential between the well annulus and the low pressure dump chamber acts in a second direction across the power piston.

The electric solenoid control valve means is preferably a normally closed electric solenoid control valve means which in the absence of electrical power is in a normally closed position wherein the power chamber is isolated from the tool side chamber portion and the low pressure dump chamber to hydraulically lock the power piston in place within the power chamber.

The electric solenoid control valve means preferably includes separate first, second, third and fourth electric solenoid control valves disposed directly in the first, second, third and fourth flow paths, respectively, for controlling flow therethrough.

The first and second electric solenoid control valves are wired in parallel so that they are actuated simultaneously. The third and fourth electric solenoid control valves are also wired in parallel so that they are actuated simultaneously.

Preferably, the apparatus also includes a pressure regulator means disposed in the first and third flow paths for regulating the fluid pressure supplied from the high pressure source chamber. This pressure regulator means is referenced to the low pressure in the dump chamber.

This operating system can be applied to many different downhole tools, and is particularly useful in connection with formation tester valves and circulating valves.

The system is constructed for use in a remote control tool in which the control valve means is controlled in response to a command signal transmitted from a remote location adjacent a well in which the tool is placed.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

The Background Environment Of The Invention

It is appropriate at this point to provide a description of the environment in which the present invention is used. During the course of drilling an oil well, the bore hole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole. Drilling fluids and formation fluids can all be generally referred to as well fluids.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole, thus closing the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well.

The well testing program includes intervals of formation flow and intervals when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
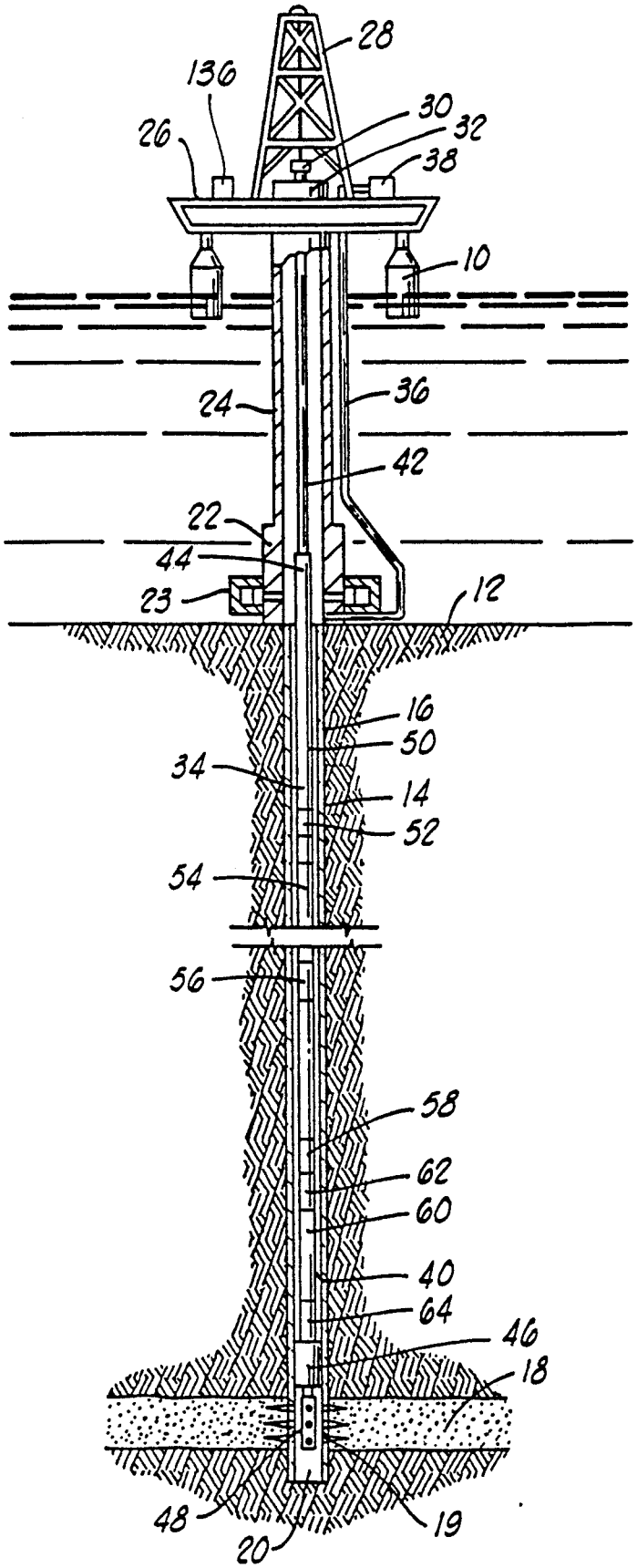
FIG. 1 is an elevation schematic view of a typical well test string in which the present invention may be incorporated.

A typical arrangement for conducting a drill stem test offshore is shown in FIG. 1. Of course, the present invention may also be used on wells located onshore.

The arrangement of the offshore system includes a floating work station 10 stationed over a submerged work site 12. The well comprises a well bore 14, which typically is lined with a casing string 16 extending from the work site 12 to a submerged formation 18. It will be appreciated, however, that the present invention can also be used to test a well which has not yet had the casing set therein.

The casing string includes a plurality of perforations 19 at its lower end which provide communication between the formation 18 and a lower interior zone or annulus 20 of the well bore 14.

At the submerged well site 12 is located the well head installation 22 which includes blowout preventer mechanisms 23. A marine conductor 24 extends from the well head installation 22 to the floating work station 10. The floating work station 10 includes a work deck 26 which supports a derrick 28. The derrick 28 supports a hoisting means 30. A well head closure 32 is provided at the upper end of the marine conductor 24. The well head closure 32 allows for lowering into the marine conductor and into the well bore 14 a formation testing string 34 which is raised and lowered in the well by the hoisting means 30. The testing string 34 may also generally be referred to as a tubing string 34.

A supply conduct 36 is provided which extends from a hydraulic pump 38 on the deck 26 of the floating station 10 and extends to the well head installation 22 at a point below the blowout preventer 23 to allow the pressurizing of the well annulus 40 defined between the testing string 34 and the well bore 14.

The testing string 34 includes an upper conduit string portion 42 extending from the work deck 26 to the well head installation 22. A subsea test tree 44 is located at the lower end of the upper conduit string 42 and is landed in the well head installation 22.

The lower portion of the formation testing string 34 extends from the test tree 44 to the formation 18. A packer mechanism 46 isolates the formation 18 from fluids in the well annulus 40. Thus, an interior or tubing string bore of the tubing string 34 is isolated from the upper well annulus 40 above packer 46. Also, the upper well annulus 40 above packer 46 is isolated from the lower zone 20 of the well which is often referred to as the rat hole 20.

A perforated tail piece 48 provided at the lower end of the testing string 34 allows fluid communication between the formation 18 and the interior of the tubular formation testing string 34.

The lower portion of the formation testing string 34 further includes intermediate conduit portion 50 and torque transmitting pressure and volume balanced slip joint means 52. An intermediate conduit portion 54 is provided for imparting packer setting weight to the packer mechanism 46 at the lower end of the string.

It is many times desirable to place near the lower end of the testing string 34 a circulation valve 56 which may be opened by rotation or reciprocation of the testing string or a combination of both or by dropping of a weighted bar in the interior of the testing string 34. Below circulating valve 56 there may be located a combination sampler valve section and reverse circulation valve 58.

Also near the lower end of the formation testing string 34 is located a formation tester valve 60. Immediately above the formation tester valve 60 there may be located a drill pipe tester valve 62.

A pressure recording device 64 is located below the formation tester valve 60. The pressure recording device 64 is preferably one which provides a full opening passageway through the center of the pressure recorder to provide a full opening passageway through the entire length of the formation testing string.

The present invention relates to a system for actuating various ones of the tools found in such a testing string 34, and relates to novel constructions of such tools designed for use with this new actuating system. Typical examples of the tools to which this new actuating system may be applied would be the formation tester valve 60 and/or the reverse circulating valve 58.

The Present Invention

Figure 2:
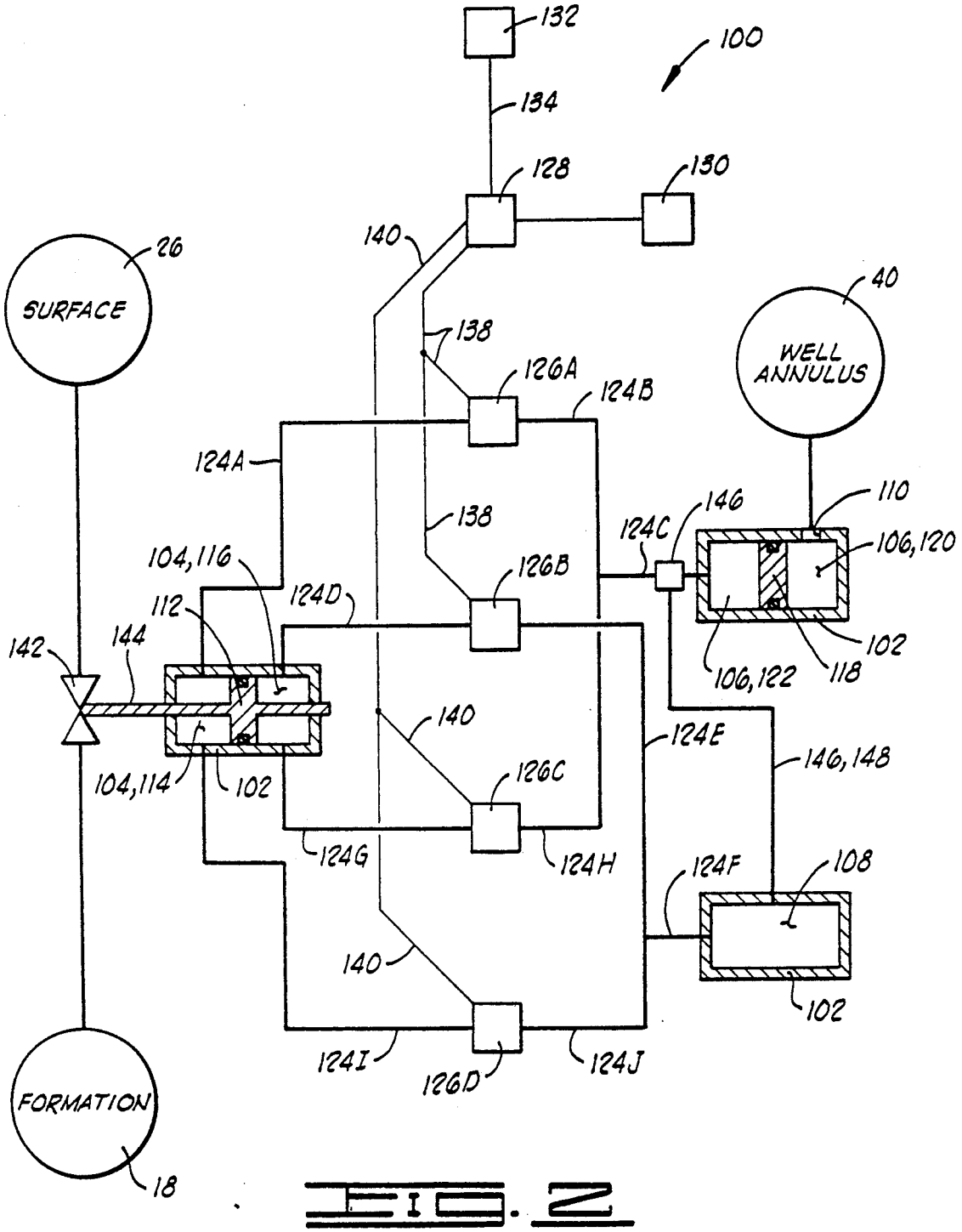
FIG. 2 is a schematic illustration of a downhole tool incorporating the hydraulic system of the present invention.

FIG. 2 schematically illustrates one embodiment of a downhole tool utilizing the present invention. In FIG. 2, a downhole tool apparatus is shown schematically and is generally designated by the numeral 100. The downhole tool apparatus 100 is a tool for use in a well such as that previously described with regard to FIG. 1. The downhole tool 100 may, for example, be a formation tester valve in the location shown as 60 in FIG. 1 or a circulating valve in the location shown as 58 in FIG. 1. The present invention could also be used with other ones of the tools shown in the tool string in FIG. 1.

The tool 100 has a housing which is schematically illustrated in FIG. 2 and designated by the numeral 102. The housing 102 has a power chamber 104 a high pressure source chamber 106, and a low pressure dump chamber 108 defined therein.

The housing 102 has a power port means 110 defined therein for communicating the high pressure source chamber 106 with the well annulus 40 surrounding the housing 102.

The apparatus 100 includes a power piston 112 slidably disposed in the power chamber 104 and dividing the power chamber 104 into first and second power chamber portions 114 and 116, respectively.

The apparatus 100 includes a pressure transfer piston 118 slidably disposed in the high pressure source chamber 106 and dividing the high pressure source chamber 106 into a well side chamber portion 120 and a tool side chamber portion 122. The well side chamber portion 120 is in fluid flow communication with the power port 110, i.e., that is fluids can flow from the well annulus 40 through the port 110 into the well side chamber portion 120.

The housing 102 further includes a power passage means 124 defined therein for providing fluid pressure communication between the power chamber 104 and each of the well side chamber portion 106 and the low pressure dump chamber 108. The power passage means 124 is made up of various passage segments designated 124A–124J.

Passage means 124 includes a first flow path defined by segments 124A, 124B and 124C, which communicates the first power chamber portion 114 with the tool side chamber portion 122 of high pressure source chamber 106.

Power passage means 124 includes a second flow path made up of segments 124D, 124E and 124F communicating the second power chamber portion 116 with the low pressure dump chamber 108.

The power passage means 124 includes a third flow path made up of segments 124G, 124H and 124C communicating the second power chamber portion 116 with the tool side chamber portion 122 of high pressure source chamber 106.

The power passage means 124 includes a fourth path made up of segments 124I, 124J and 124F communicating the first power chamber portion 114 with the low pressure dump chamber 108.

The apparatus 100 includes a electric solenoid control valve means 126 including individual normally closed electric solenoid control valves 126A, 126B, 126C, and 126D directly disposed in the power passage means 124 for selectively controlling fluid pressure communication between the power chamber 104 and each of the tool side chamber portion 122 and the low pressure dump chamber 108.

The apparatus 100 further includes a microprocessor based electronic control package 128 powered by batteries or other power source 130. A sensing means 132 is operatively connected to control package 128 by wiring 134. The sensor 132 is designed to receive a command signal transmitted from a remote location 136 located upon the work deck 26 adjacent the well.

A first electrical wiring means 138 interconnects the microprocessor based electronic control package 128 with the first and second electric solenoid control valves 126A and 126B, so that those valves are connected in parallel and are actuated at the same time. Similarly, a second electrical wiring means 140 connects the third and fourth electric solenoid control valves 126C and 126D with the electronic control package 128 so that the third and fourth control valves 126C and 126D are also connected in parallel so that they are actuated at the same time.

The electronic solenoid control valve means 126 has a first position wherein valves 126A and 126B are energized and held open and valves 126C and 126D are not energized and thus are closed so that the first power chamber portion 114 is communicated with the tool side chamber portion 122 of high pressure source chamber 106 and the second power chamber portion 116 is communicated with the low pressure dump chamber 108 so that a pressure differential between the well annulus 40 and the low pressure dump chamber 108 acts in a first direction from left to right as seen in FIG. 2 across the power piston 112 to move it from left to right.

The electric solenoid control valve means 126 has a second position wherein the third and fourth valves 126C and 126D are energized and thus held open and the first and second valves 126A and 126B are not energized and thus are closed, thus communicating the first power chamber portion 114 with the low pressure dump chamber 108 while communicating the second power chamber portion 116 with the tool side chamber portion 122 of high pressure source chamber 106 so that the pressure differential between the well annulus 40 and the low pressure dump chamber 108 acts in a second direction from right to left as seen in FIG. 2 across the power piston 112 thus moving the power piston 112 back from right to left within the power chamber 104.

Finally, the electric solenoid control valve means 126 has a third position wherein all of the valves 126A, 126B, 126C and 126D are non-energized and thus are in their normally closed positions thus isolating both sides of the power chamber 104 from the tool side chamber portion 122 of high pressure source chamber 106 and from the low pressure dump chamber 108 thus hydraulically locking the power piston 112 in place within the power chamber 104 at whatever location the power piston 112 wa at when the electric solenoid control valve means 126 was deenergized. Thus, the power piston 112, which typically will move between a leftmost position and a rightmost position within the chamber 104 as seen in FIG. 2, can be hydraulically locked in either of those positions.

A clean hydraulic fluid substantially fills the tool side chamber portion 122 of high pressure source chamber 106, the first and second power chamber portions 114 and 116 of power chamber 104, and the power passage means 124. Each time the power piston 112 is stroked through the power chamber 104, a volume of clean hydraulic fluid equal to the displacement of the stroke of piston 112 will be dumped into the dump chamber 108, and an equal volume of fluid will be displaced from the tool side chamber portion 122 of high pressure source chamber 106. Thus, there is a limitation on the number of strokes through which the power piston 112 can be moved dependent upon the supply of clean hydraulic fluid in the tool side chamber portion 122.

As previously mentioned, the electric solenoid control valve means 126 is directly disposed in the power passage means 124 to control fluid pressure communication between the power chamber 104 and the tool side chamber portion 122 of high pressure source chamber 106 and the dump chamber 108. More specifically, the first normally closed electric solenoid control valve 126A is disposed directly in the first flow path 124A, 124B, 124C for controlling fluid pressure communication between the first power chamber portion 114 and the tool side chamber portion 122 of high pressure source chamber 106. The second normally closed electric solenoid control valve 126B is disposed directly in the second flow path 124D, 124E, 124F to control fluid pressure communication between the second power chamber portion 116 and the low pressure dump chamber 108. The third normally closed electric solenoid control valve 126C is disposed directly in the third flow path 124G, 124H, 124C for controlling fluid pressure communication between the second power chamber portion 116 and the tool side chamber portion 122 of high pressure source chamber 106. The fourth normally closed electric solenoid control valve 126D is disposed directly in the fourth flow path 124I, 124J, 124F for controlling fluid pressure communication between the first power chamber portion 114 and the low pressure dump chamber 108.

As the power piston 112 strokes back and forth within the power chamber 104, it will operate an operating element 142 with which it is operatively associated through an operating mechanism 144. The operating element 142 may be of many different varieties corresponding to the various tools within the testing string 34 illustrated in FIG. 1 and previously described.

For example, the operating element 142 may be a rotating ball valve type element of a formation tester valve 60 having an operating mechanism substantially like that shown in U.S. Pat. No. 3,856,085 to Holden et al., the details of which are incorporated herein by reference.

As another example, the operating element 142 could be a sliding sleeve valve of a reclosable reverse circulation valve 58 having an associated operating mechanism 144 substantially like that shown in U.S. Pat. No. 4,113,012 to Evans et al., the details of which are incorporated herein by reference. Preferably, the indexing system of the Evans et al. tool would be deleted.

Also, a multi-mode operating element could be used substantially like that shown in U.S. Pat. No. 4,711,305 to Ringgenberg, the details of which are incorporated herein by reference.

A pressure regulator means 146 is disposed in passage section 124C which is part of the first and third flow paths, for regulating the fluid pressure supplied from the high pressure source chamber 106 to the first and third electric solenoid valves 126A and 126C in the first and third flow paths. The pressure regulator means 146 includes a reference pressure conduit 148 communicated with the low pressure dump chamber 108. Thus, the pressure regulator means 146 is referenced to the substantially atmospheric pressure in the dump chamber 108, and controls the pressure from high pressure source chamber 106 so that the pressure provided from the well annulus 40 to the electric solenoid control valves 126A and 126C exceeds the pressure in dump chamber 108 by a predetermined value. For example, with the pressure in dump chamber 108 being substantially zero, the pressure regulator 146 could be set to provide a pressure from the well annulus 40 to the electric solenoid control valve means 126A and 126C of 1,000 psi greater than the zero pressure present in the dump chamber 108.

The purpose of this pressure regulation is to limit the pressure differential which acts across the electric solenoid control valve means 126A and 126C which thereby reduces the electrical power requirements needed to operate those control valves.

Techniques For Remote Control

Many different systems can be utilized to send command signals from the surface location 26 down to the sensor 132 to control the tool 100.

One suitable system is the signaling of the control package 128, and receipt of feedback from the control package 128, using acoustical communication which may include variations of signal frequencies, specific frequencies, or codes of acoustical signals or combinations of these. The acoustical transmission media includes tubing string, casing string, electric line, slick line, subterranean soil around the well, tubing fluid, and annulus fluid. An example of a system for sending acoustical signals down the tubing string is seen in U.S. Pat. Nos. 4,375,239; 4,347,900; and 4,378,850 all to Barrington and assigned to the assignee of the present invention.

A second suitable remote control system is the use of a mechanical or electronic pressure activated control package 128 which responds to pressure amplitudes, frequencies, codes or combinations of these which may be transmitted through tubing fluid, casing fluid, fluid inside coiled tubing which may be transmitted inside or outside the tubing string, and annulus fluid.

A third remote control system which may be utilized is radio transmission from the surface location or from a subsurface location, with corresponding radio feedback from the tool 100 to the surface location or subsurface location.

A fourth possible remote control system is the use of microwave transmission and reception.

A fifth type of remote control system is the use of electronic communication through an electric line cable suspended from the surface to the downhole control package.

A sixth suitable remote control system is the use of fiberoptic communications through a fiberoptic cable suspended from the surface to the downhole control package.

A seventh possible remote control system is the use of acoustic signaling from a wire line suspended transmitter to the downhole control package with subsequent feedback from the control package to the wire line suspended transmitter/receiver. Communication may consist of frequencies, amplitudes, codes or variations or combinations of these parameters.

An eighth suitable remote communication system is the use of pulsed X-ray or pulsed neutron communication systems.

As a ninth alternative, communication can also be accomplished with the transformer coupled technique which involves wire line conveyance of a partial transformer to a downhole tool. Either the primary or secondary of the transformer is conveyed on a wire line with the other half of the transformer residing within the downhole tool. When the two portions of the transformer are mated, data can be interchanged.

All of the systems described above may utilize an electronic control package 128 that is microprocessor based.

It is also possible to utilize a preprogrammed microprocessor based control package 128 which is completely self-contained and is programmed at the surface to provide a pattern of operation of the downhole tool which it controls. For example, a remote control signal from the surface could instruct the microprocessor based electronic control package 128 to start one or more preprogrammed sequences of operations. Also, the preprogrammed sequence could be started in response to a sensed downhole parameter such as bottom hole pressure. Such a self-contained system may be constructed in a manner analogous to the self-contained downhole gauge system shown in U.S. Pat. No. 4,866,607 to Anderson et al., and assigned to the assignee of the present invention.

Thus it is seen that the present invention readily achieves the ends and advantages mentioned as well as those inherent therein. While certain preferred embodiments of the invention have been described and illustrated for purposes of the present disclosure, numerous changes may be made by those skilled in the art which changes are encompassed within the scope and spirit of the present invention as defined by the appended claims.

What is claimed is:

1. A downhole tool apparatus, comprising:

a housing having a power chamber, a high pressure source chamber and a low pressure dump chamber defined therein, said housing having a power port means defined therein for communicating said high pressure source chamber with a well annulus surrounding said housing;

a power piston slidably disposed in said power chamber and dividing said power chamber into first and second power chamber portions;

a pressure transfer piston, slidably disposed in said high pressure source chamber and dividing said high pressure source chamber into a well side chamber portion and a tool side chamber portion, said well side chamber portion being in fluid flow communication with said power port means;

said housing further includes power passage means defined therein for providing fluid pressure communication between said power chamber and each of said tool side chamber portion and said low pressure dump chamber, said power passage means including:

a first flow path communicating said first power chamber portion with said tool side chamber portion of said high pressure source chamber;

a second flow path communicating said second power chamber portion with said low pressure dump chamber;

a third flow path communicating said second power chamber portion with said tool side chamber of said high pressure source chamber; and a fourth flow path communicating said first power chamber portion with said low pressure dump chamber; and electric solenoid control valve means, disposed directly in said power passage means, for selectively controlling fluid pressure communication between said power chamber and each of said tool side chamber portion and said low pressure dump chamber, said electric solenoid control valve means having:

a first position wherein said first power chamber portion is communicated with said tool side chamber portion and said second power chamber portion is communicated with said low pressure dump chamber, so that a pressure differential between said well annulus and said low pressure dump chamber acts in a first direction across said power piston; and a second position wherein said first power chamber portion is communicated with said low pressure dump chamber and said second power chamber portion is communicated with said tool side chamber portion so that said pressure differential between said well annulus and said low pressure dump chamber acts in a second direction across said power piston; and pressure regulator means, disposed in said first and third flow paths, for regulating the fluid pressure supplied from said high pressure source chamber and for thereby limiting a pressure differential across said electric solenoid control valve means in said first and third flow paths and for thereby reducing the electric power required to operate said electric solenoid control valve means.

2. The apparatus of claim 1, wherein:

said electric solenoid control valve means further has a third position wherein said power chamber is isolated from said tool side chamber portion and said low pressure dump chamber to hydraulically lock said power piston in place within said power chamber.

3. The apparatus of claim 2, wherein:

said electric solenoid control valve means is a normally closed electric solenoid control valve means which is normally in a closed position in the absence of electric power, said closed position being said third position.

4. The apparatus of claim 1, wherein:

said electric solenoid control valve means is a normally closed electric solenoid control valve means which in the absence of electrical power is in a normally closed position wherein said power chamber is isolated from said tool side chamber portion and said low pressure dump chamber to hydraulically lock said power piston in place within said power chamber.

5. The apparatus of claim 1, further comprising:

a clean hydraulic fluid substantially filling said tool side chamber portion, said first and second power chamber portions and said power passage means.

6. The apparatus of claim 1, further comprising:

a formation tester valve element disposed in said housing and operably associated with said power piston so that said formation tester valve element is moved between closed and open positions thereof as said power piston means moves within said power chamber.

7. The apparatus of claim 1, further comprising:

a circulation valve element operably associated with said power piston so that said circulation valve element is moved between closed and open positions thereof as said power piston moves within said power chamber.

8. The apparatus of claim 1, further comprising:

remote control means for controlling said electric solenoid control valve means in response to a command signal transmitted from a remote location adjacent a well in which said apparatus is placed.

9. The apparatus of claim 1, wherein:

said pressure regulator means includes a reference pressure conduit communicated with said low pressure dump chamber.

10. A downhole tool apparatus, comprising:

a housing having a power chamber, a high pressure source chamber and a low pressure dump chamber defined therein, said housing having a power port means defined therein for communicating said high pressure source chamber with a well annular surrounding said housing;

a power piston slidably disposed in said power chamber and dividing said power chamber into first and second power chamber portions;

a pressure transfer piston, slidably disposed in said high pressure source chamber and dividing said high pressure source chamber into a well side chamber portion and a tool side chamber portion, said well side chamber portion being in fluid flow communication with said power port means;

said housing further includes power passages means defined therein for providing fluid pressure communication between said power chamber and each of said tool side chamber portion and said low pressure dump chamber, said power passage means including;

a first flow path communicating said first power chamber portion with said tool side chamber portion of said high pressure source chamber;

a second flow path communicating said second power chamber portion with said low pressure dump chamber;

a third flow path communicating said second power chamber portion with said tool side chamber of said high pressure source chamber; and a fourth flow path communicating said first power chamber portion with said lower pressure dump chamber; and electric solenoid control valve means, disposed directly in said power passage means, for selectively controlling fluid pressure communication between said power chamber and each of said tool side chamber portion and said low pressure dump chamber, said electric solenoid control valve means having:

a first position wherein said first power chamber portion is communicated with said tool side chamber portion and said second power chamber portion is communicated with said low pressure dump chamber, so that a pressure differential between said well annulus and said low pressure dump chamber acts in a first direction across said power piston; and a second position wherein said first power chamber portion is communicated with said low pressure dump chamber and said second power chamber portion is communicated with said tool side chamber portion so that said pressure differential between said well annulus and said low pressure dump chamber acts in a second direction across said power piston; and wherein said electric solenoid control valve means further includes:

a first electric solenoid control valve, disposed directly in said first flow path, for controlling fluid pressure communication between said first power chamber portion and said tool side chamber portion of said high pressure source chamber;

a second electric solenoid control valve, disposed directly in said second flow path, for controlling fluid pressure communication between said second power chamber portion and said low pressure dump chamber;

a third electric solenoid control valve, disposed directly in said third flow path, for controlling fluid pressure communication between said second power chamber portion and said tool side chamber portion of said high pressure source chamber; and a fourth electric solenoid control valve, disposed directly in said fourth flow path, for controlling fluid pressure communication between said first power chamber portion and said low pressure dump chamber.

11. The apparatus of claim 10, wherein:

each of said first, second, third and fourth electric solenoid control valves is a normally closed electric solenoid control valve.

12. The apparatus of claim 10, wherein said electric solenoid control valve means further comprises:

first electrical wiring means for connecting said first and second electric solenoid control valves in parallel so that they are actuated at the same time; and second electrical wiring means for connecting said third and fourth electric solenoid control valves in parallel so that they are actuated at the same time.

13. A downhole tool apparatus, comprising:

a housing having a power chamber, a high pressure source chamber and a low pressure dump chamber defined therein, said housing having a power port means defined therein for communicating said high pressure source chamber with a well annular surrounding said housing;

a power piston slidably disposed in said power chamber and dividing said power chamber into first and second power chamber portions;

a pressure transfer piston, slidably disposed in said high pressure source chamber and dividing said high pressure source chamber into a well side chamber portion and a tool side chamber portion, said well side chamber portion being in fluid flow communication with said power port means;

said housing further includes power passage means defined therein for providing fluid pressure communication between said power chamber and each of said tool side chamber portion and said low pressure dump chamber;

electric solenoid control valve means for selectively controlling fluid pressure communication between said power chamber and each of said tool side chamber portion and said lower pressure dump chamber, said electric solenoid control valve means having:

a first position wherein said first power chamber portion is communicated with said tool side chamber portion and said second power chamber portion is communicated with said lower pressure dump chamber, so that a pressure differential between said well annulus and said low pressure dump chamber acts in a first direction across said power piston; and a second position wherein said first power chamber portion is communicated with said low pressure dump chamber and said second power chamber portion is communicated with said tool side chamber portion so that said pressure differential between said well annulus and said low pressure dump chamber acts in a second direction across said power piston; and pressure regulator means for regulating the fluid pressure supplied from said high pressure source chamber to said electric solenoid control valve means; and wherein said electric solenoid valve means comprises:

a first electric solenoid control valve for controlling fluid pressure communication between said first power chamber portion and said tool side chamber portion of said high pressure source chamber;

a second electric solenoid control valve for controlling fluid pressure communication between said second power chamber portion and said low pressure dump chamber;

a third electric solenoid control valve for controlling fluid pressure communication between said second power chamber portion and said tool side chamber portion of said high pressure source chamber; and a fourth electric solenoid control valve for controlling fluid pressure communication between said first power chamber portion and said low pressure dump chamber.

14. The apparatus of claim 13, wherein:

said pressure regulator means is further characterized as a means for limiting a pressure differential across said electric solenoid control valve means and for thereby reducing the electric power required to operate said electric solenoid control valve means.

15. The apparatus of claim 13, wherein:

said pressure regulator means includes a reference pressure conduit communicated with said low pressure dump chamber.

16. The apparatus of claim 13, wherein:

said electric solenoid control valve means further has a third position wherein said power chamber is isolated from said tool side chamber portion and said low pressure dump chamber to hydraulically lock said power piston in place within said power chamber.

17. The apparatus of claim 16, wherein:

said electric solenoid control valve means is a normally closed electric solenoid control valve means which is normally in a closed position in the absence of electric power, said closed position being said third positions.

18. The apparatus of claim 13, wherein said electric solenoid control valve means is a normally closed electric solenoid control valve means which in the absence of electrical power is in a normally closed position wherein said power chamber is isolated from said tool side chamber portion and said lower pressure dump chamber to hydraulically lock said power piston in place within said power chamber.

19. The apparatus of claim 13, further comprising:

a clean hydraulic fluid substantially filling said tool side chamber portion, said first and second power chamber portions and said power passage means.

20. The apparatus of claim 12 wherein:

each of said first, second, third and fourth electric solenoid control valves is a normally closed electric solenoid control valve.

21. The apparatus of claim 13 wherein said electric solenoid control valve means further comprises:

first electrical wiring means for connecting said first and second electric solenoid control valves in parallel so that they are actuated at the same time; and second electrical wiring means for connecting said third and fourth electric solenoid control valves in parallel so that they are actuated at the same time.

22. The apparatus of claim 13, further comprising:

a formation tester valve element disposed in said housing and operably associated with said power piston so that said formation tester valve element is moved between closed and open positions thereof as said power piston means moves within said power chamber.

23. The apparatus of claim 13, further comprising:

a circulation valve element operably associated with said power piston so that said circulation valve element is moved between closed and open positions thereof as said power piston moves within said power chamber.

24. The apparatus of claim 13, further comprising:

remote control means for controlling said electric solenoid control valve means in response to a command signal transmitted from a remote location adjacent a well in which said apparatus is placed.

25. A method of operating a downhole tool, comprising:

providing a power passage in said tool connecting a power piston of said tool with a well annular outside said tool and with a lower pressure dump chamber in said tool;

operating at least one electric solenoid control valve disposed directly in said power passage to selectively apply a pressure differential in alternating directions across said power piston to operate said tool;

isolating said electric solenoid control valve and said power piston from contact with well fluid from said well annulus; and regulating fluid pressure supplied from said well annulus to said electric solenoid control valve.

26. The method of claim 25, wherein:

said regulating step is further characterized as limiting a pressure differential across said electric solenoid control valve and thereby reducing the electric power required to operate said electric solenoid control valve.

27. The method of claim 25, wherein:

said regulating step is further characterized as regulating said fluid pressure supplied from said well annulus by reference to a pressure in said low pressure dump chamber so that the pressure provided from said well annulus to said electric solenoid control valve exceeds said pressure in said low pressure dump chamber by a predetermined value.

* * * * *